US010179668B2

(12) United States Patent
Bray et al.

(10) Patent No.: US 10,179,668 B2
(45) Date of Patent: Jan. 15, 2019

(54) PACKAGING MACHINE AND METHOD

(75) Inventors: Anthony Bray, London (GB); Gary Fallon, London (GB); Roger Beck, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 945 days.

(21) Appl. No.: 12/523,482

(22) PCT Filed: Jan. 16, 2008

(86) PCT No.: PCT/EP2008/050459

§ 371 (c)(1),
(2), (4) Date: Dec. 7, 2009

(87) PCT Pub. No.: WO2008/090071

PCT Pub. Date: Jul. 31, 2008

(65) Prior Publication Data

US 2010/0170202 A1 Jul. 8, 2010

(30) Foreign Application Priority Data

Jan. 23, 2007 (GB) ..... 0701257.8

(51) Int. Cl.
*B65B 19/00* (2006.01)
*B65B 59/00* (2006.01)
(Continued)

(52) U.S. Cl.
CPC ..... *B65B 59/00* (2013.01); *B65B 19/02* (2013.01); *B65B 65/003* (2013.01); *B65B 2210/02* (2013.01)

(58) Field of Classification Search
CPC ... B65B 59/00; B65B 2230/04; B65B 65/003; B65B 65/006; B65B 19/00; B65B 19/02; B65B 19/22; B65B 19/221
(Continued)

(56) References Cited

U.S. PATENT DOCUMENTS 4,053,741 A * 10/1977 Ainoya ..... B23Q 41/06 131/910
4,085,759 A * 4/1978 Seragnoli ..... B65G 37/02 131/283
(Continued)

FOREIGN PATENT DOCUMENTS

EP 1645513 A2 4/2006
EP 1695913 A2 8/2006
(Continued)

OTHER PUBLICATIONS

PCT International Search Report and Written Opinion.
(Continued)

*Primary Examiner* — Robert Long
*Assistant Examiner* — Chelsea Stinson
(74) *Attorney, Agent, or Firm* — Cantor Colburn LLP

(57) ABSTRACT

A method and machine for packaging smoking articles or other tobacco industry products in which the products and packaging may be transported from selected product supply systems and packaging material supply systems selectively along a plurality of alternative transport routes through the machine through a series of workstations arranged to incorporate batches of smoking products selectively in different packaging materials according to the transport route selected.

2 Claims, 7 Drawing Sheets

(51) Int. Cl.
*B65B 19/02* (2006.01)
*B65B 65/00* (2006.01)

(58) Field of Classification Search
USPC ..... 53/444, 148, 153, 154, 201, 236, 449, 53/170, 173, 202
See application file for complete search history.

(56) References Cited

U.S. PATENT DOCUMENTS 4,373,624 A * 2/1983 Molins ..... A24C 5/35 198/347.3
4,892,453 A * 1/1990 Bantien ..... A24C 5/352 198/468.11
5,209,247 A * 5/1993 Rittershaus ..... A24C 5/20 131/58
5,628,162 A * 5/1997 Kreusch et al. ..... 53/168
6,158,194 A * 12/2000 Horn et al. ..... 53/148
6,381,920 B1 * 5/2002 Bailey et al. ..... 53/234
6,718,727 B2 * 4/2004 Focke et al. ..... 53/168
7,117,872 B2 * 10/2006 Draghetti et al. ..... 131/280
7,584,589 B2 * 9/2009 Stafford et al. ..... 53/154
7,891,158 B2 * 2/2011 Stafford et al. ..... 53/446
2004/0011002 A1 * 1/2004 Sendo et al. ..... 53/234
2005/0145259 A1 * 7/2005 Focke ..... B65B 19/228 131/283
2007/0101683 A1 * 5/2007 Bray et al. ..... 53/444

FOREIGN PATENT DOCUMENTS

EP 1862387 A2 12/2007
JP 07-267208 10/1995

OTHER PUBLICATIONS

International Preliminary Report on Patentability dated May 18, 2009.
International Search Report for corresponding PCT/EP2008/050459, filed Jan. 16, 2008, dated Jul. 31, 2008.
Written Opinion for corresponding PCT/EP2008/050459, filed Jan. 16, 2008, dated Jul. 23, 2009.
International Preliminary Report on Patentability for corresponding PCT/EP2008/050459, filed Jan. 16, 2008, dated Jul. 23, 2009.

* cited by examiner

PACKAGING MACHINE AND METHOD

CLAIM FOR PRIORITY

This application is a National Stage Entry entitled to and hereby claims priority under 35 U.S.C. §§ 365 and 371 corresponding to PCT Application No. PCT/EP2008/050459, titled, "Packaging Machine and Method," filed Jan. 16, 2008, which in turn claims priority to British Application Serial No. GB 0701257.8, filed Jan. 23, 2007, all of which are hereby incorporated by reference.

The invention relates to packaging machines. More specifically, the invention relates to machines, methods and systems for packing tobacco industry products.

Manufacturing and assembling methods and machines vary significantly depending on factors such as type of product, volume and speed of production, accuracy requirements, and cost limitations. For certain applications, dedicated or single-purpose machines are ideal. They offer the ability to rapidly and consistently produce identical products.

In a typical machine for packaging tobacco industry products, products and packaging materials are transported to a delivery point through a plurality of work stations for performing successive assembly operations thereon to incorporate batches of products in individual packs formed from the packaging material.

Cigarette packing machines are known which can produce upwards of eight hundred packs of cigarettes per minute. They are large, specialized, expensive machines which, to be profitable, must be continuously run at high speed, producing large volumes of identical product with low rates of stoppage. The period during which the machine is shut down for repairs, maintenance, or to accommodate product changes is to be reduced to a minimum. Such high-speed packaging machines are designed to maximize efficiencies. The production line is compressed into a single rapidly-moving track. Specialized tasks are performed at the work stations along the track by various machine components, whose speed and timing are determined based on how many passing products the component will need to affect and how quickly they are passing. The entire machine thus operates as a unit whose actions are dictated by the speed of the central track. To increase production speeds, is it known to provide similar parallel track to feed the same components into a line for producing a single pack. For example, a single assembly track may be fed simultaneously by two tracks supplying cigarettes, one line providing batches of 12 cigarettes arranged side by side in a bundle, the other 13 in a similar bundle, the lines merging to form single batches of 25, made up of one bundle of 12 lying on top of one bundle of 13.

However, single track, highly specialized machines dedicated to the production of one pack configuration can require extensive re-working to adapt them to product changes, and even then the potential degree of change is limited. New products often necessitate entirely new machines and production lines, which are expensive to design and build and take many months of careful planning, and many more months, even years, to build.

Requirements for packaging and labeling of products can change over time and can differ from one market to another, thereby increasing the demand for changes in the design of products and packaging. Such packaging changes are expensive and time consuming to implement in conventional machines.

Small production runs of products can be produced by hand packaging processes. However, hand-packaging is slow, expensive and produces a less consistent level of quality than packing processes involving high-speed machines.

According to the present invention there is provided a machine and method for packaging tobacco industry products in which the products and packaging material are subjected to successive assembly operations that incorporate products in packs formed from the packaging material, and in which the products and packaging material may be subjected selectively to different sequences of assembly operations, whereby successive batches of the same or different products may be incorporated in the same or different packs according to the sequence selected.

More specifically, in accordance with the invention, products and packaging materials are transported through a plurality of work stations for performing successive assembly operations thereon that incorporate products in packs formed from the packaging material, and selectively subjected to different sequences of assembly operations at the work stations, whereby successive batches of the same or different products may be incorporated in the same or different packs according to the sequence selected.

By providing a plurality workstations that can be operated selectively to define different sequences of assembly operations on the smoking products and packaging materials, a flexible manufacturing system can be created which particularly facilitates medium, mechanised production runs of packs of products that are too long for efficient production by hand-packing and which frequent changes in the type of product or pack produced.

Preferably, at least one of the workstations that performs one sequence of assembly operations may be conditioned to perform its operation whilst other workstations are performing another sequence of assembly operations. In this way the period of down time of the machine between successive runs can be reduced.

Successive runs may contain the same product in different packs, different products in the same pack, or different products in different packs, according to the sequence of workstations selected and the packaging material and products provided. For example, successive batches of products may consist of cigarettes of different flavours, filter types, or sizes, or cigars, or cigarillos. The packaging may, for example be in the form of sleeve- and tray packs in one batch, and, in the next batch, in the form of pre-formed packs, such as drums or blister packs, flip-top packs, or packs of non-rectangular cross-section (e.g. triangular or rhomboidal cross-section packs).

More particularly, a machine for packaging tobacco industry products in accordance with the invention comprises means for transporting products into the machine, means for transporting packaging materials into the machine, and a plurality of work stations disposed along one or more transport routes through the machine, the work stations being capable of performing successive assembly operations on at least one of the products and the packaging materials to incorporate products in packaging material to form a finished product, wherein the machine comprises means for controlling the movement of the products and the packaging materials along the transport routes and the workstations in order to subject the products and the packaging materials selectively to a first sequence of assembly operations to form a first finished product or to a second sequence of assembly operations different from the first sequence to form a second finished product. Either or both the products, and the packaging materials of the first finished product may be different from those of the second finished product.

The invention specifically includes a machine for packaging smoking products comprising means for transporting smoking products into the machine, means for transporting packaging materials into the machine, and a plurality of work stations for performing successive assembly operations on the smoking products and the packaging materials to incorporate smoking products in packs formed from the packaging material as they are transported through the machine to a delivery point, wherein the smoking articles and packaging material may be selectively subjected to different sequences of assembly operations at the work stations whereby successive batches of smoking products and packaging materials may be packaged differently according to the sequence selected.

The invention also specifically includes a packaging process for tobacco industry products comprising optionally subjecting tobacco industry products to one or more assembly operations at one or more work stations to provide a unit of tobacco industry products, optionally subjecting packaging material to one or more assembly operations at one or more work stations to provide a unit of packaging, and incorporating the unit of tobacco industry products in the unit of packaging to provide a finished product, wherein the tobacco industry product and the packaging material are selectively subjected to a first set of assembly operations to form a first finished product, or a second sequence of assembly operations to form a second finished product, the first sequence of assembly operations and the second sequence of assembly operations differing from each other. One or both of the tobacco industry product and the packaging material could differ between the first finished product and the second finished product.

In order to enable the selection of a desired combination of workstations, the preferred machines of the invention define one or more transport paths or routes through the work stations for the smoking products packaging materials. In one embodiment of the invention, the work stations are positioned serially along a single transport route and operated selectively according to the particular pack being assembled. For example a first series of workstations adapted to assemble a sleeve and tray type pack may be located on the transport route upstream of downstream of a second series of workstations adapted to assemble a blister type pack, the first series of workstations being disabled during a production run of a lid and sleeve type pack, and vice versa, so that the packaging material and the products pass through the disabled workstations unaffected.

Alternatively, the products and packaging materials may be transported selectively through the machine along multiple alternative transport routes arranged in parallel, the work stations being arranged to incorporate batches of smoking products selectively in different packaging materials according to the transport route selected.

In some machines of the invention the workstations for performing the different operations are arranged in series along a common transport route, and others are arranged along transport routes that run in parallel.

According to another aspect of the invention, there is provided a machine for packaging smoking products which comprises means for transporting smoking products into the machine, means for transporting packaging materials into the machine, a packer for incorporating smoking products in packaging material, and means for transporting packaged smoking products to a delivery point wherein the smoking products may be transported selectively along a plurality of alternative transport routes through the machine, and the packer is arranged to incorporate batches of smoking products selectively in different packaging materials according to the transport route selected.

In this aspect of the invention, the transport route can be chosen to pack batches of similar smoking products in respective individual units of similar packaging materials, to pack batches of similar smoking products in respective individual units of dissimilar packaging materials, or to pack at least one batch of a first smoking product and at least one batch of a second smoking product in an individual unit of packaging material, such as when the first smoking product has a first flavour and the second smoking product has a second flavour or the first smoking product is a first size and the second smoking product is a second size.

A machine according to the invention may further comprise a computer storage medium having a computer program encoded therein, e.g., for controlling the means for transporting smoking products, the means for transporting packaging materials, packers, the means for transporting packaged smoking products, or any combination thereof.

The invention encompasses an article of manufacture comprising a computer readable medium having computer readable program code means embedded therein, wherein the computer readable program code means causes a computer to instruct a machine of the invention to carry out a packaging process in accordance with the invention.

As used herein, "tobacco industry product(s)" or "product (s)" refer to any items made or sold in the tobacco industry including (a) tobacco for pipes or for roll-your-own cigarettes, and traditional smoking products such as cigarettes, cigarillos, and cigars (whether based on tobacco, tobacco derivatives, expanded tobacco, reconstituted tobacco or tobacco substitutes); (b) non-smoking products incorporating tobacco, tobacco derivatives, tobacco substitutes, expanded tobacco and reconstituted tobacco, such as snuff, snus, hard tobacco, and heat-not-burn products (i.e. inhalation devices in which an aerosol for inhalation by a consumer is driven from a source material, which may be based on tobacco, by the application of heat to the material without causing combustion thereof) and (c) smoking cessation aids and other nicotine-delivery systems such as adhesive patches, inhalers, lozenges, and gums.

The preferred machines and processes according to the invention are capable of accommodating frequent, short-term and significant changes in products and packaging while still being capable of faster production than hand-assembly. They can further facilitate successive production runs in which products of the same type are packaged in different types of packs, or in which different products are packaged in similar types of packs. The time taken for changeover of the machines from one packaging is significantly reduced compared to many machines conventionally used in the packaging of tobacco-industry products, especially cigarette packing machines.

The machines of the invention may be used to pack standard tobacco industry products, e.g. cigarettes, and alternative tobacco industry products, such as snus, and oral nicotine delivery products such as gums, lozenges and patches. The packaging used on the machines may also be of a standard form, which, for cigarettes, is typically formed by folding and gluing flat blanks, usually made of card. The packaging may also be non-standard, for example pre-formed, non-folded packs, which may be formed by injection moulding, vacuum-forming or by other moulding techniques. Generally, higher operating speeds and shorter machine down-times will be experienced in machines of this invention in which the different products are all of the same general type—for example cigarettes of different flavours—and the packaging is also of the same general type, for example either different blister packs or packs formed from different folded blanks.

It will be understood that where embodiments of the invention are described with reference to the packaging of standard products in standard packs, the invention is clearly not limited to such forms of product or packaging.

The preferred machines for packing smoking products according to the present invention consist of a number of components and work stations, each of which attend to a specific task.

The machines of the invention incorporate means for transporting tobacco industry products into the machine. The means for transporting products will usually comprise one or more means for storing a supply of products, from which products are fed into the machine. The machines of the invention may included at least 2, 3, 4 or more such product storage means.

The products may be stored in bulk form, for example in the form of a volume of individual cigarettes contained in a reservoir, or in discrete units, such as pre-formed bundles, which may be unwrapped, or wrapped in foil, paper or other film material, or in pre-filled packs to be subjected to further packaging operations. Storage systems of different types may be used in conjunction with appropriately-modified feed lines to transport different products into the machine, and any of the numerous systems used in conventional machines for packaging tobacco industry products may be used. For example, the storage means may comprise one or more hoppers from which, or from each of which, a respective product may be fed into the machine. Hoppers are suitable for example where the products to be packed are cigarettes. Storage systems for other products may include open-ended or open-sided boxes with products contained therein, vessels for liquids and means for dispensing the liquid.

Alternatively, the means for transporting products may include a direct or indirect connection to the output of production equipment. For example, a machine for making products, e.g. a cigarette making machine, could be arranged to deliver products into a machine of the invention either directly or via a storage area or buffer. The machine for making products may for example be a cigarette making machine, supplying cigarettes individually, or it may include a mechanism for supplying the products in batches or in bundles, which may, if desired be wrapped in foil or paper or other material. In other cases the products may be fed serially into a conveyor device contained in the transporting means such that they may be retrieved individually or in groups by another machine component.

The means for transporting products may be configured to supply pre-formed units of product, for example pre-made, optionally wrapped, bundles of cigarettes or individually pre-wrapped cigars.

The machine of the invention also comprises means for transporting packaging materials into the machine, which delivers packaging materials to the machine. The packaging materials can vary widely. For example they may be in the form of blanks for forming "tray and sleeve" cigarette packs, cigarette cases, blister packaging and others. The machines of the invention may include at least 2, 3, 4 or more such means for transporting packaging materials. The construction of the packaging transport means will depend upon the nature of the packaging material used. For example the transport means may incorporate storage means such as a hopper, which might be preferred where the packaging material is in the form of blanks, or any of a variety of bins and boxes, which might be open-ended to allow a separate machine component to retrieve items therefrom. Where the packaging material is in the form of a sheet or strip of material, the packaging storage means may be in the form of a reel of such material and the packaging transport means may be in the form of a series of rollers over which the sheet or strip of material is suitably tensioned and fed to the machine. Other examples include magazines capable of holding blanks, trays with a plurality of open edges, and belts or lines with pockets configured to receive packaging articles.

The means for transporting packaging can be configured to dispense discrete units or batches of packaging materials as desired.

The packaging material may be in the form of pre-formed and ready-to-pack units that do not require further assembly or manipulation by a work station prior to being loaded with the product, for example hinged cigarette cases, where a work station would be configured to select a bundle, place it in a case, and close the case, or cigar tubes ready for loading with cigars.

The means for transporting packaging materials may also be a connection to the output of a packaging material making unit. When so provided, it may be preferred to have an intermediate buffer or storage area to ensure steady and sufficient supply of packaging materials to the machine. The packaging material making unit may include equipment for printing, cutting, or on-line creasing of blanks, or may include equipment for producing packaging material from plastics materials, e.g. injection-moulding or vacuum-forming equipment.

As with other elements of the invention, known modules may be adapted for use in a machine according to the invention. For example packaging materials may be supplied to the machine of the invention from rotary or linear feed systems similar to those used to feed standard, single track high-volume packaging machines, which may include a plurality of interconnected packing and transfer wheels.

The preferred machines of the invention also comprise a plurality of work stations at which the products and packaging material may be subjected to different sequences of assembly operations as appropriate for the individual product and packaging materials used. For example one work station or set of work stations may be constructed so as to form the cigarettes or other products into bundles; an additional work station may then wrap the bundles in foil or other wrapping material, or otherwise cluster them in a desired configuration. Another work station or set of work stations may be constructed so as to form the packaging materials into a desired configuration, for example, by retrieving a blank, folding it into a pack shape and gluing one or more edges to seal the pack. A further work station would then place the thus-formed batch of products into the unit of packaging material.

Subsequently along the transport route work stations could perform additional functions such as affixing a tax revenue stamp, over-wrapping, cartoning and palleting.

In the preferred machines of the invention the packs will normally be transported to a delivery point.

The means for transporting packaged products take any conventional form, for example a sloped series of rollers upon which packages roll freely, pulled by gravitational forces. Another option is to provide a motorized transport band or a series of discrete cups or boxes which carry one or more packages each. The cups or boxes could be connected together, for example, with a chain or belt. Alternatively, the means for transporting packaged product could comprise a line or chain of linked cups or boxes adapted to the shape of the articles. Any known materials or methods for transporting products which could progress packaged smoking products rapidly, accurately and reliably would be applicable to the present invention.

The preferred machines of the invention transports the tobacco industry products and packaging materials through a plurality of work stations at which successive assembly operations are performed. In contrast to conventional high-speed packaging machinery, the machine of the invention is arranged to allow the products and packaging materials to be subjected selectively to different sequences of assembly operations, according to the particular products and packaging materials being processed at the time. To achieve this, the work stations may be arranged to define multiple alternative transport routes through the machine for the products and the packaging materials. With such an arrangement, the work stations along each transport route perform a different sequence of assembly operations, each adapted to the manufacture of packs having a different combination of product or packaging.

The sequence of assembly operations to which the products and packaging materials are subjected is preferably determined by the provision of transfer equipment that, within the machine of the invention receives products or packaging materials as an input, and directs the product or packaging as an output. The input to the transfer equipment may comprise a single source of product or packaging material, or multiple (2, 3 or more) sources thereof. Similarly, the output may be a single further work station in the machine, or multiple (2, 3 or more) workstations. The transfer equipment may be operated selectively to transfer products or packaging material from a selected input and deliver them to a selected output, depending upon which sequence of assembly operations are being used. Any desired number of transport routes may be defined between the workstations by positioning multiple units of transfer equipment between successive workstations.

Preferably the transfer equipment is robotic or numerically controlled. In a sophisticated form, the transfer equipment may for example comprise an articulated arm the end of which is capable of being positioned relative to three orthogonal axes, and carrying an end effectuator capable of manipulating packaging or products about three orthogonal axes relative to the end of the arm, giving 6 degrees of freedom of movement in the positioning of the products or packaging material. Less complex transfer equipment may be used where simpler transfer operations are required. For example a simple pick and place units, or lifting or sliding systems operating in a single plane may be used where it is required to move product or packaging material from one or more parallel input lines to one or other of multiple output lines arranged parallel with the input lines.

For example, one transport route may extend from a first hopper, which in use contains cigarettes of a first kind (having for example a particular flavour or filter construction), through a first series of work stations for packaging the cigarettes into a first type of pack, for example a conventional sleeve and tray pack, to a wrapper for wrapping the packs in film, and then to a carton packer, which packages the film-wrapped packs in cartons. A second transport route may extend from the first hopper through a second series of work stations for packaging the cigarettes in a second type of pack, for example conventional hinge-lid pack, and then to the film wrapper and the carton packer. A third transport route may extend from a second hopper for cigarettes of a second kind (having for example a flavour or filter construction different from the first kind), through the first series of work stations to the film wrapper and the carton packer. A fourth transport route may extend from the second hopper through the second series of work stations to the film wrapper and carton packer. By selectively operating those parts of the machine associated with one of the four transport routes, up to four different combinations of packaging and product may be produced from the same machine.

Moreover, whilst one of the transport routes is in operation, those elements of the machine that define another alternative transport route can be prepared for use. For example, in the machine described above, whilst the first transport route is in use, the second hopper and the second series of work stations can be prepared for use. When the production run using the first route is complete, the next production run using the second transport route can be started with a minimum of delay.

It will be appreciated that the foregoing is a simplified description of the assembly process, for illustration only.

In the foregoing arrangement, the transport routes are arranged in parallel along at least part of their route. In some circumstances it may be possible to construct the machine in such a way that the work stations define a single transport route through the machine. For example, using the same work stations as described above, the transport route may extend from a first hopper, through the first series of work stations, then through the second series of work stations and then to the film wrapper and carton packer. The first product can then be packaged in packs of the two different types simply by selectively operating the first or second sets of work stations. By making the first and second hoppers interchangeable, cigarettes of the second type could be incorporated in packs of either type. As a further alternative, the two hoppers could be arranged in parallel to feed product into the transport route.

The preferred machines of the invention can be configured to work efficiently even where the products and their packaging require different amounts of time or process steps to be assembled or otherwise processed. For example, if a transport route for packaging articles provides packaging at a rate of one unit per second, and a transport route for smoking products provides smoking products at a rate of one unit per two seconds, two transport routes for smoking products can be provided thus maximizing efficiency of the machine.

The work station which packs articles into packaging may be configured so as to be capable of selectively incorporating batches of smoking products in different packaging materials. This feature allows for unlimited combinations of different articles to be packed in different packages, requiring only reconfiguration and new instructions along the transport route and at that individual work station to accommodate the change. Instructions would be related to directing how and when to move articles toward the work station doing the packing, and how that work station should select and manipulate the chosen objects. The work stations may be configured and programmed to handle one set of products which it places in a first packaging material to form a packed unit, and subsequently to incorporate that packed unit into a second packaging material.

One example of this is pack in which a bundle of cigarettes, which may or may not be wrapped, is packed in an inner frame, the inner frame with the bundle of cigarettes being subsequently packed in an outer frame to make a finished pack. A work station configured to produce such a pack may for example comprise a unit for holding the packaging material, and working in concert with mechanisms for forming the inner and outer frames, and for picking and placing the bundles into the inner frame, and the filled inner frames into the outer frame. Suitable mechanisms, such as vacuum-operated holding devices, finger mechanisms for manipulating packaging and products, and pick-up mechanisms for picking up, placing and otherwise manipulating the pertinent products and packs, are well know to those skilled in the art.

The machine of the invention may comprise a number of other modules depending on the specific needs of the goods being packaged. For example, where single packs of cigarettes are transported to the delivery point, it could be expected that they are further processed according to known methods. The transport route through the machine to the delivery point therefore may include workstations for functions such as labeling, inspection, placement of coupons or inserts, application of tax stamps, wrapping, for example with film, including heat-shrinkable film, vacuum-packing or incorporation into a formed carton which can also be labeled and wrapped and formed in a case. These workstations may be positioned next to each other, or integrated elsewhere into any of the transport routes through the machine of the invention, according to the particular ranges of products and packaging materials to be used on the machine.

One or more of the work stations of the machine of the invention may be operated and controlled individually by individual control systems. Alternatively, or in addition, groups of work stations may be linked together by a control network that operates and controls the group as a sub-system of the machine. Preferably the means for transporting product, the means for transporting packaging and the work stations include individual drive mechanisms that are controlled from a common control system such as a central electronic control system or computer. The provision of a central control allow for efficiency and changeability. The common control system is preferably operated by a computer code, or software, that determines which individual systems within the product and packaging transport means are active; which workstations within the machine are actively working; operating speeds; operating sequences; and operating schedules. By this means the computer is used to instruct the machine to perform the different assembly operations. Programming the control of the work stations in this way also enable the machine to be switched between different modes of operation with a minimum of delay.

As is known to skilled persons, the desired amount of finished product can be input into a common control unit such as a computer which then calculates the amount of materials and consumables needed based on that amount. Materials and consumables could include, for example, tobacco industry products, foils, thermoplastic materials, packaging blanks, revenue stamps and the like. Taking into account the typical rejection rate, production errors and the like, a central control system can produce instructions as to the amounts of different materials that should be provided from a source such as a warehouse to each component of the unit requiring materials or consumables. This allows production runs to be set up with the amount of each sort of material that is reasonably expected to be required in order to produce the desired amount of end-product with the minimal amount of excess.

Particularly for runs which might require replenishment of materials, the central control system could monitor quality control aspects such as the numbers of units rejected for error or damage. Ongoing calculations would allow adjustments to the amounts of starting materials actually required to complete the desired amount of finished product. The control system could rely on sensors or monitors associated with each component or with groups of components.

In addition to other aspects as known in the art, the control system can determine the relative speeds of operation of the work stations and ensure that any materials required by each workstation are delivered to it in accordance with its speed of operation. The machine of the invention may incorporate one or more buffer stations in which product, packaging materials, or partially-packed product, can accumulate and then released at an appropriate rate. The buffer stations may be provided at the start of, or at any suitable point along any of the transport routes. They may be adapted to allow the operator of the machine to replenish the machine with material for processing, for example in extended production runs, thereby increasing the efficiency of the machine operator in serving the demands of each workstations.

Where a longer-term production run is foreseen, because of the modular system of the invention it can be determined which step or stage of the packing process determines the rate of operation of the unit, and provide components effecting that step or stage in plural. For example, if packed, wrapped product accumulates at the end of the production line waiting for removal to the storage or transport facilities, additional forklifts or other suitable devices can be provided to allow for faster removal of packed goods and thus allow for an increase in speed of the overall unit.

In order that the subject invention may be easily understood and readily carried into effect, reference will now be made, by way of example, to the accompanying diagrammatic drawings, in which.

Figure 3:
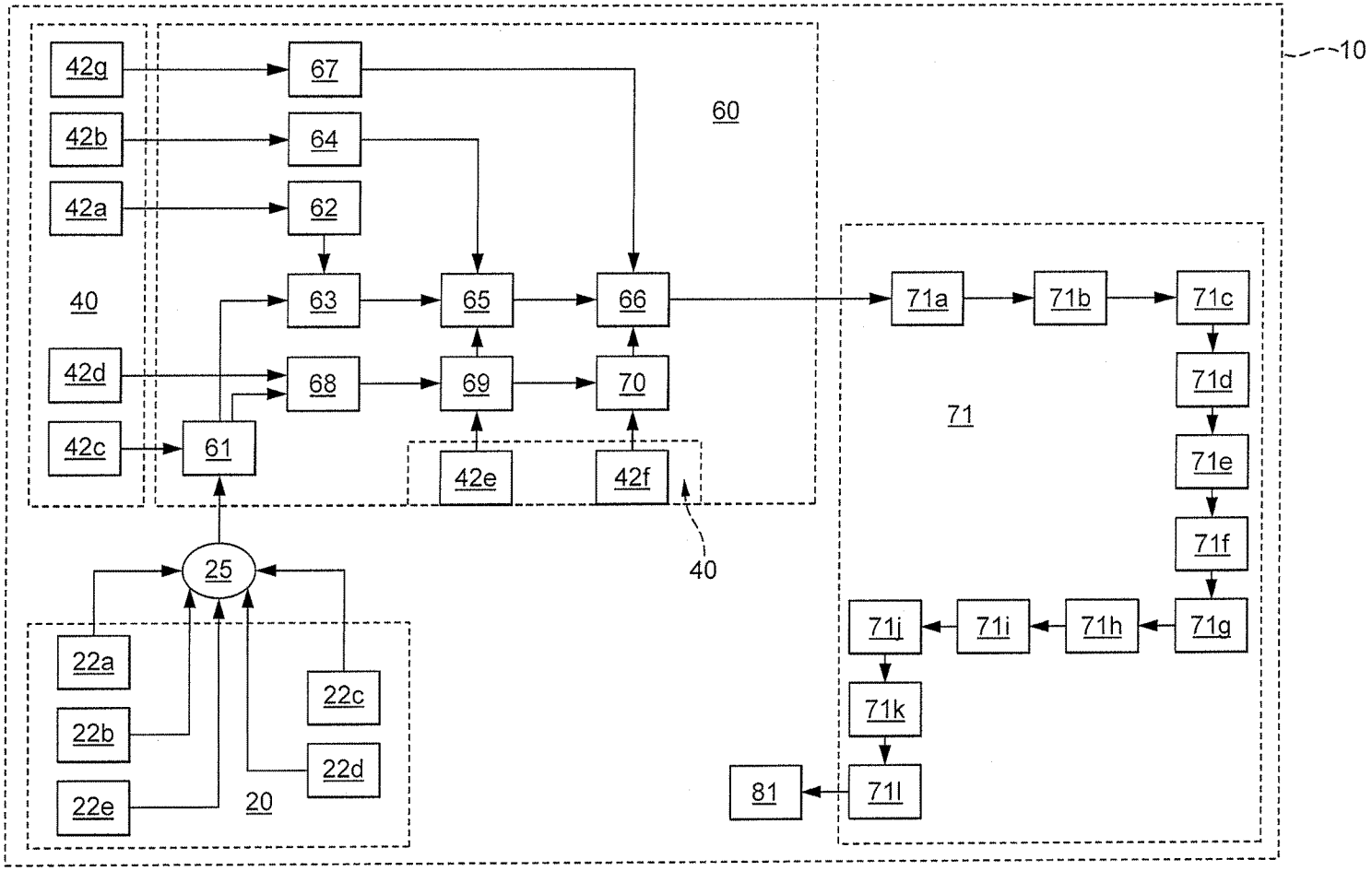
FIG. 3 is a functional diagram of a second embodiment of a machine according to the invention.
Figure 4:
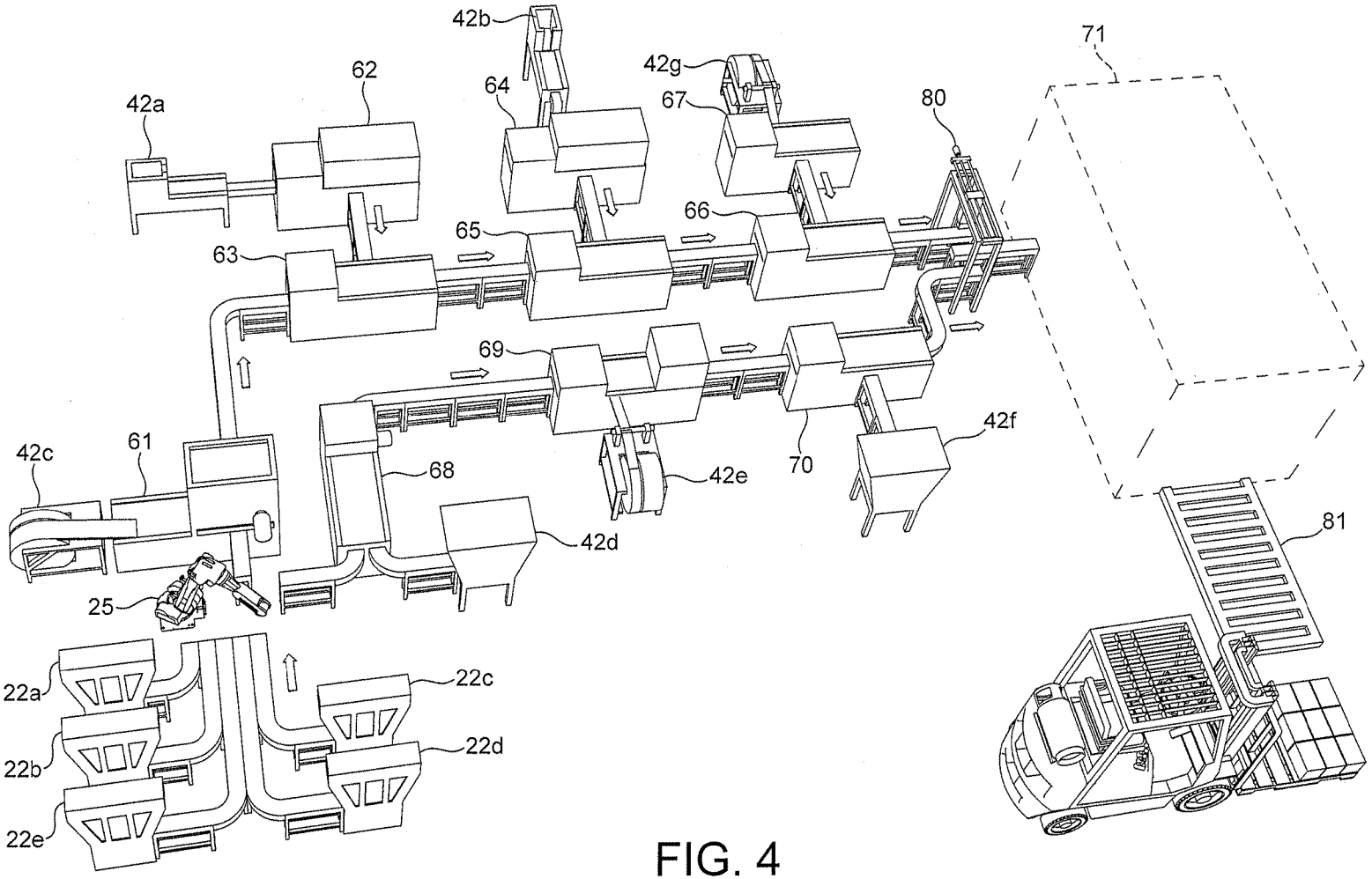
FIG. 4 is a schematic layout of a machine constructed according to FIG. 3.
Figure 4A:
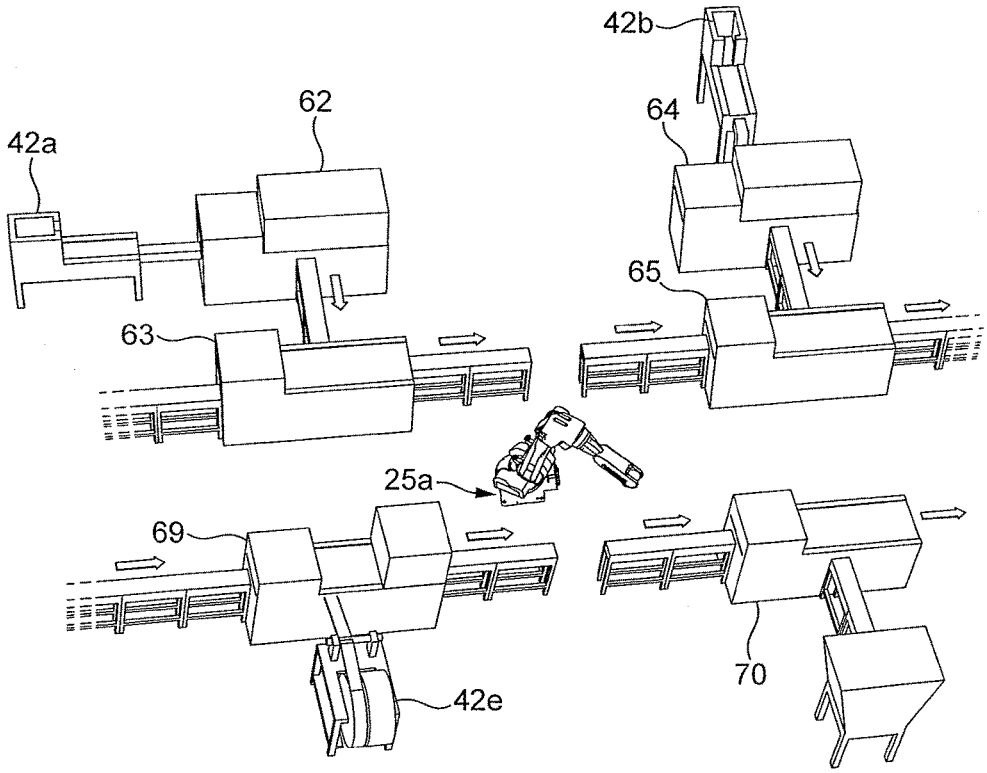
Figure 5:
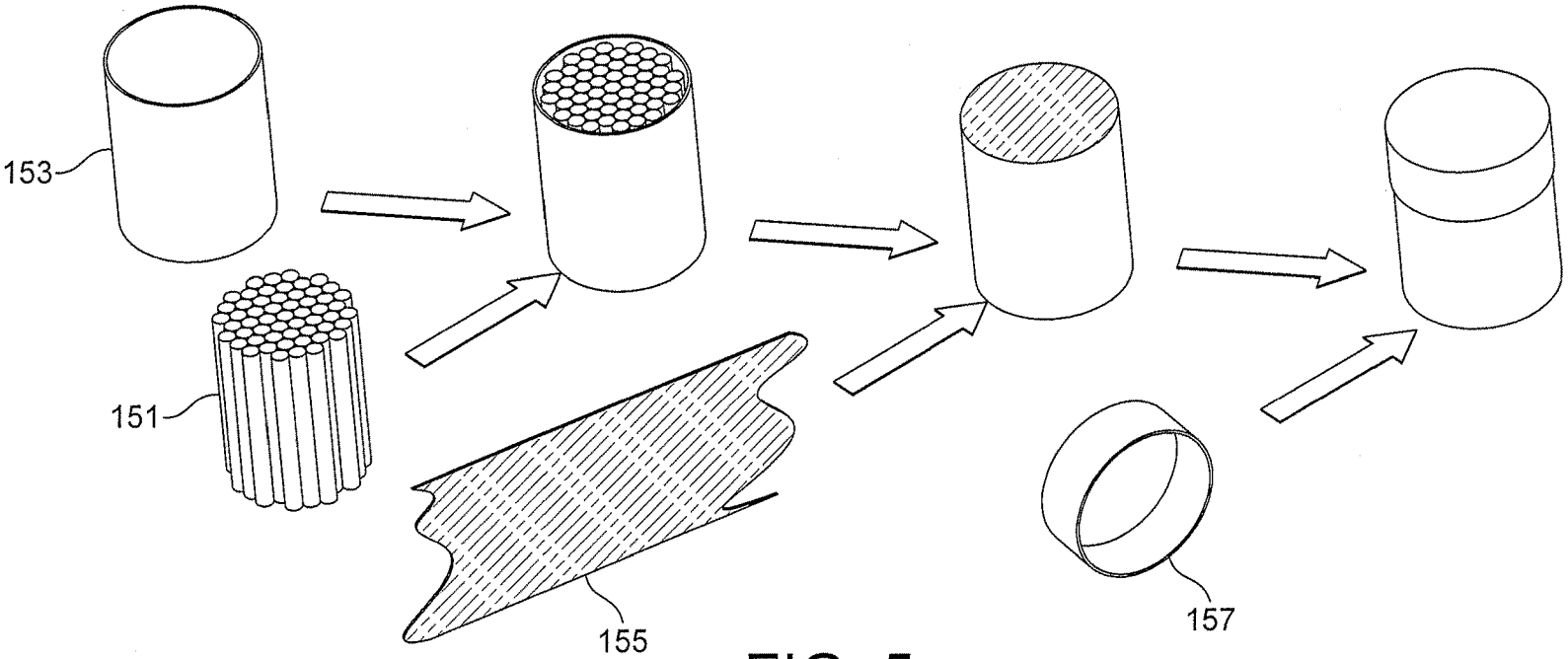
Figure 6:
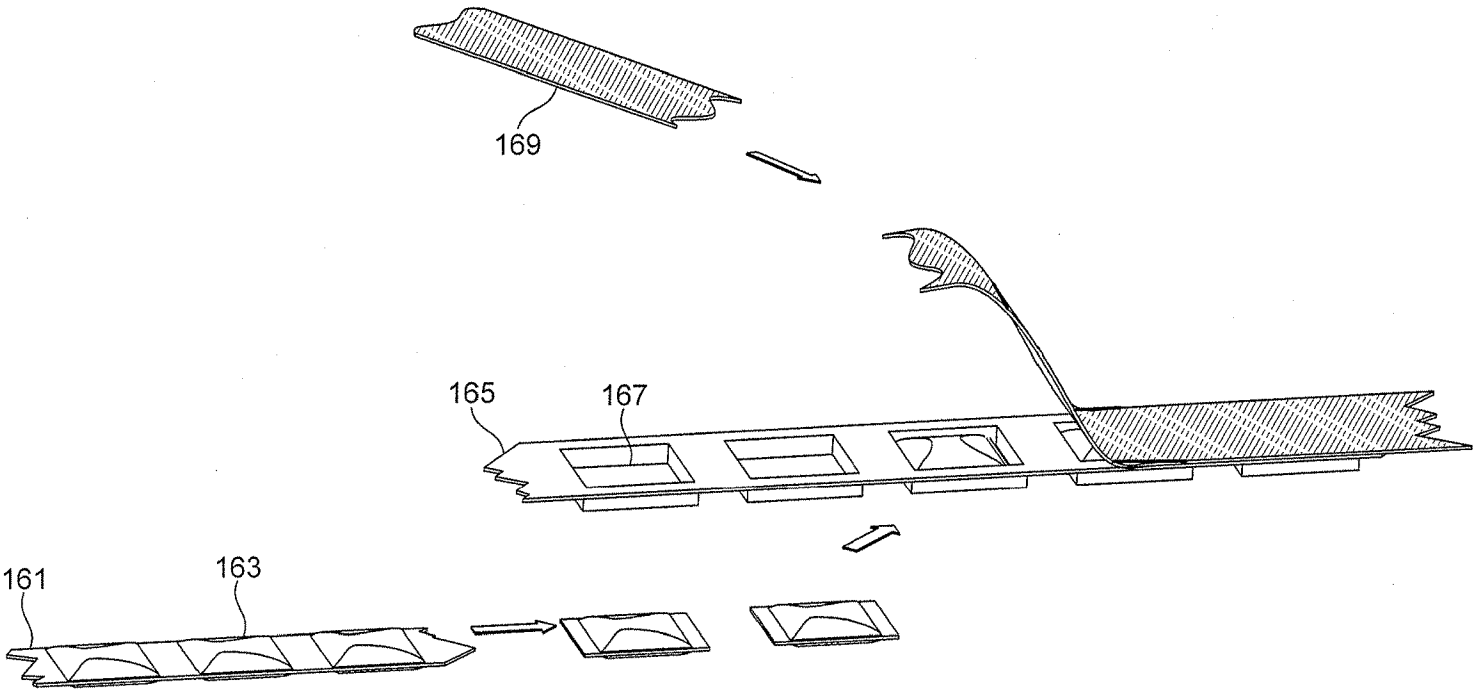

FIG. 4*a* is a partial schematic layout of a modification of the machine illustrated in FIGS. 3 and 4, showing the modified part of the machine;

FIG. 5 illustrates a further sequence of assembly operations performed by workstations in a machine of the invention; and FIG. 6 illustrates a still further sequence of assembly operations performed by workstations in a machine of the invention.

In the drawings, like items in different embodiments are identified by like reference numerals.

Figure 1:
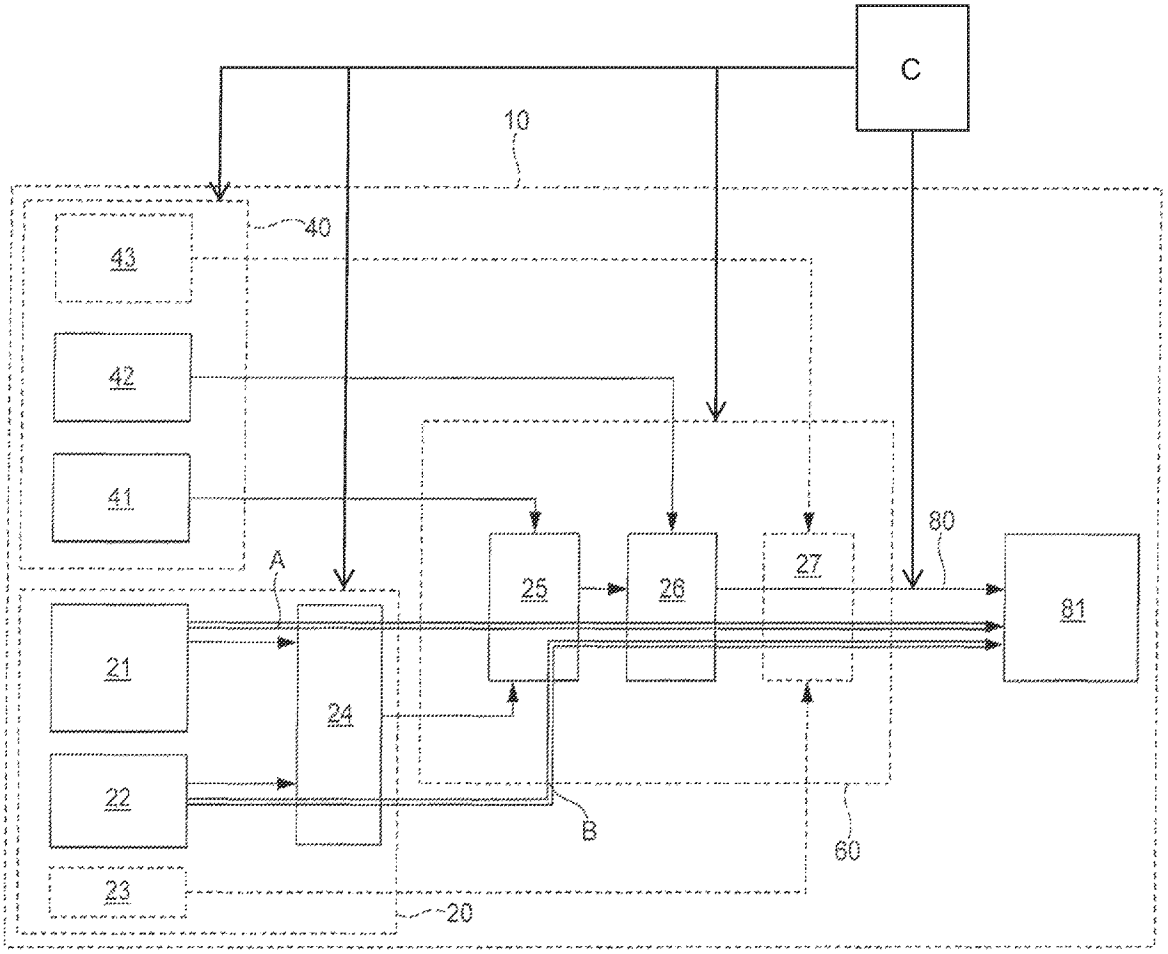
FIG. 1 is a functional diagram of a first embodiment of a machine according to the invention.

Referring to FIG. 1, the functional interactions of the major systems of a first embodiment of a machine in accordance with the invention are illustrated. The machine 10 comprises means 20 for transporting tobacco industry products into the machine, means 40 for transporting packaging materials into the machine, a packer 60 for incorporating batches of products in individual units of packaging material, and means 80 for transporting packs of products to a delivery point 81.

The transporting means 20, 40, 80 and the packer 60 are operated by conventional electrical drives having digital electronic control systems that are operated in coordination with each other from a central programmable computer control device C. The control device C itself has a program code means installed therein, whereby the computer may instruct a machine to carry out any of the sequences of operation of the machine described herein. The construction of the control device C and the program code will vary according to the equipment used in each embodiment, but the design thereof will be within the capability of any person skilled in the art.

The operation of this machine will be illustrated in a number of examples.

EXAMPLE 1

In a first example of the operation of this machine, the machine 10 is configured to pack two alternative types of cigarette in a conventional "flip-top" pack. Further details of the pack and the process by which it is assembled are shown in FIG. 2.

Figure 2:
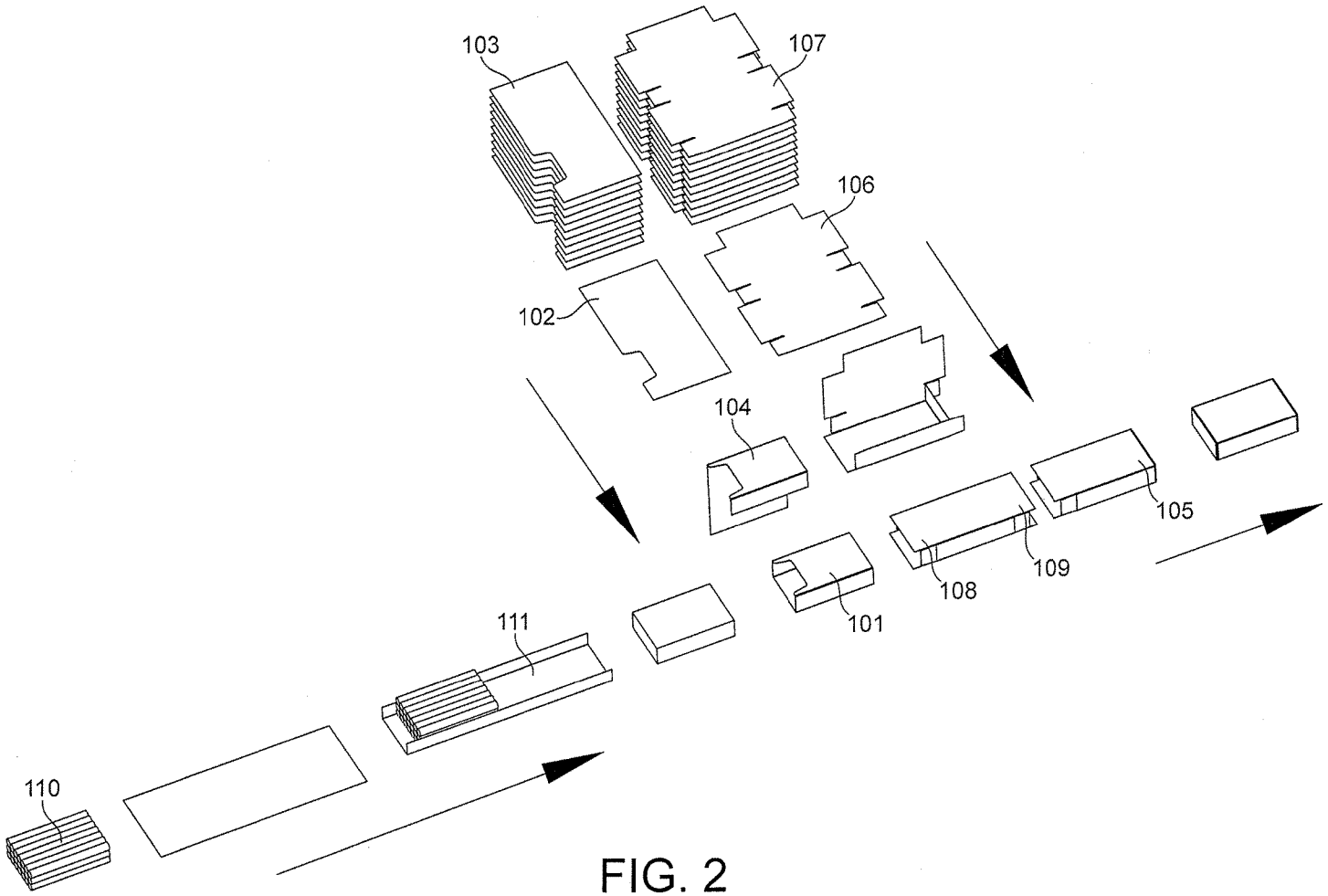
FIG. 2 illustrates a sequence of assembly operations performed by workstations in the machine of FIG. 1.

As shown in FIG. 2, the pack comprises an inner frame 101 and an outer frame 105. The inner frame 101 is of rectangular cross section, formed from a flat blank 102, held in a stack 103. Blanks 102 are extracted in succession from the stack 103, glued along one edge, folded as indicated at 104, erected, and closed by an end flap. The inner frame 101 is slidingly received in the outer frame 105, of rectangular cross section corresponding to that of the inner frame 101. The outer frame 105 is also formed from a flat blank 106, held in a stack 107. Blanks for the outer frame are extracted in succession from the stack 107, glued along one edge, folded, erected and closed at one end by a bottom flap 109 and at the other end by a flip-top lid 108. The pack incorporates a bundle 110 of cigarettes, wrapped in foil 111 and arranged, in this example, in three layers, the two outer layers having seven cigarettes, the inner layer having six. Other configurations for the bundle are of course possible, and the bundles may be wrapped in other materials than foil, or may not be wrapped In this example, the bundle 110 of cigarettes is first wrapped in foil, and then inserted into the erected inner frame 101, which is then in turn inserted into the erected outer frame 105. The ends and lid of the outer frame are then closed, as illustrated.

Referring to FIG. 1, the means 20 for transporting products comprises a first product supply system 21 for transporting a first product into the machine for packing, in this case foil-wrapped bundles of twenty cigarettes 110, and a second product supply system 22 for transporting a second product in batches into the machine. In this example, the second product is also in the form of foil-wrapped bundles of twenty cigarettes.

The means 20 for transporting products also includes transfer equipment 24, e.g. in the form of a pick and place device, for transferring product selectively from the first or second product supply systems 21, 22 to the packer 60. Where the transfer equipment 24 is numerically controlled, it can be pre-programmed to operate in either one of these two modes, and the mode of operation can be changed quickly and easily by selecting the appropriate control programme, with minimum downtime of the machine.

The means 40 for transporting packaging materials to the machine comprises first and second packaging material supply systems 41, 42 for the inner and outer frames 101 and 105 respectively. The two systems each comprise a hopper (not shown) for storing the stacks of blanks 102, 106, and a conveyor system for removing successive blanks from the hopper and transporting them one-by-one to the packer 60.

The packer 60 comprises two work stations 25, 26 arranged in series, each of which performs a series of operations on the materials supplied to it. In the first work station 25, individual blanks 102 for the inner frame are transported from the hopper in the first packaging material supply system 41, glued along one edge, folded, and erected to from the inner frame 101, as illustrated in FIG. 2. A foil-wrapped bundle 110 of cigarettes received from either the first or second product supply systems 21, 22 is inserted into the inner frame. In the second work station 26, blanks 106 for the outer frame are transported from the hopper in the second packaging material supply system 42, glued, folded and erected to form a sleeve, as illustrated in FIG. 2. An inner frame 101 containing a bundle of cigarettes 110 is inserted into the outer frame, which is then closed at the bottom and the top. The assembled packs are then transported from the packer to the delivery point 81.

By selecting the mode of operation of the transfer equipment 24, the machine 10 can be operated so that product is transported selectively to the packer 60 from either the first or second product supply system 21, 22 and from there to the delivery point 81 along either of the two transport routes A, B indicated by arrows in FIG. 1. It will be appreciated that the two transport routes are arranged in parallel from the first and second product supply systems 21,22 and then follow a common path through the packer 60 to the delivery point 81. The expression "in parallel" is used in relation to the systems 21, 22 to distinguish their configuration from an "in series" configuration, and not to describe the physical relationship between the transport routes. In practice, the physical locations of the components of the machine may define transport paths that, whilst being configured in parallel, are physically located to run radially, intersect, or along any other appropriate directions.

In use, the first product supply system 21 is loaded with product of a first type, e.g. filter cigarettes without menthol flavouring, and the packaging material supply systems 41, 42 are loaded with inner and outer packaging blanks 102, 106. The machine 10 is then operated with the transfer equipment 24 in its first mode of operation so that which filter cigarettes of the first type are fed in to the machine, formed into foil-wrapped bundles, transported along the first transport route A, assembled into inner frames 101 in the first work stations 25, and then into outer frames 105 in the second work station 26. The assembled packs are then transported to the delivery point 81.

If it is desired to change the production run to produce the same or similar packs containing a second type of product, for example cigarettes with a menthol flavour, the second product supply system 22 is loaded with menthol cigarettes. This step can be performed without interrupting the operation of the machine. The machine is then deactivated, the second packaging supply system 42 is loaded with blanks 106 suitable for menthol cigarettes, and the machine is reactivated with the transfer equipment 24 in its second mode of operation, so that the menthol cigarettes are now transported through the machine along the alternative transport route B from the second product supply system 22 to the delivery point 81 via the first and second set of work stations 25, 26. The changeover in production can therefore be effected quickly and easily without extensive down time of the machine 10 simply by configuring the machine as far as possible for the next production run whilst the current production run is in operation, and then configuring the transfer equipment 24 to provide the alternative transport route for the product through the machine.

EXAMPLE 2

In a second example of the operation of the machine 10 of FIG. 1, the machine 10 is configured to package two tobacco industry products of different types in a single package material. The first product comprises single pouches of smokeless tobacco, and the second product comprises lozenges, and both products are packaged in blister packs of a similar construction.

FIG. 6 generally shows an assembly procedure as applied to portions of smokeless tobacco, known as snus.

In this example, the first product supply system 21 of FIG. 1 comprises a strip 161 of wrapper material composed of cellulose acetate fleece and formed into a series of discrete sealed pouches 163. Each pouch contains a portion of tobacco sealed in the wrapper material. Methods and machines for forming, packing, and sealing individual portions of smokeless tobacco or snus in a strip of cellulose acetate fleece are known to skilled persons. The strip 161 may be provided folded or wound to form a reel to facilitate use. The first product supply system 21 further comprises cutting means to separate the strip into discreet pouches. Alternatively, the pouches 163 may be provided to the machine as a plurality discrete, ready-divided units. The pouches 163 are transported via the transfer equipment 24 along the first transport route A and received at the first work station 25 of the packer 60.

The first package material supply system 41 in this embodiment comprises a system for transporting a blister strip 165 into the machine 10. The blister strip 165 comprises a sheet of packaging material formed with rectangular recesses 167, each configured to hold a pouch of smokeless tobacco or another tobacco industry product such as a nicotine lozenge, or a nicotine patch. The blister strip 165 may be made from plastic materials, including multi layer plastics, or from foil, paper, cardboard, or other suitable material. The material may be selected for barrier-forming properties, such as moisture impermeability, and may be coated, opaque, transparent, and/or coloured, and may carry printed matter.

The blister strip 165 extends into the first work station 25 of the packer 60, at which a single pouch 163 of smokeless tobacco is placed in each recess 167. The first work station 25 may also be provided with means to spray a humectant and a flavourant onto each pouch 163. The blister strip 165 is then transported to the second work station 26 which is also supplied with further packaging material from the second packaging supply system 42. This further packaging material is in the form of a sealing strip 169 which is used to close recesses 167 and seal the pouches within.

The sealing strip 165 could be made from any suitable material, such as plastics, foil, paper or mixtures thereof as described for the blister strip. In this embodiment, the sealing strip 169 is formed from a multi-layer film. The first layer is an environmentally-impermeable plastic which is capable of forming heat-bonded seals with the plastics material of the blister strip 165. The second layer is a paper, adhered to the plastic, onto which information relating to the product inside is printed.

The sealing strip 169 is preferably sized and shaped so as to register with the blister strip 165 portions without requiring trimming steps and without causing excess waste. It may include adhesive means to allow it to form a seal with the blister strip, alternatively or in addition it may be heat sealed, glued, crimped, or otherwise manipulated at the second work station 26 to form a seal over the blister strip. Either or both of the sealing strip 169 and the blister strip 165 may be pre-treated or treated at the work second station 26 to facilitate adherence, for example by scoring surfaces to make them rough and more receptive to a liquid adhesive. Where adhesive is used, means are preferably provided to align the portions of the sealing strip carrying adhesive with the non-recessed portions of the blister strip 165 and thus avoid contamination caused by contact between the tobacco industry product and the adhesive.

The sealing strip 169 may be configured so that it can be peeled away from the recessed blister during use, for example by providing an unsealed edge which is easily grasped by a user; alternatively the sealing strip 169 may be of sufficiently deformable material so that the packaged tobacco industry product unit may be pushed through it. The sealing strip 169 may incorporate a backing to form a tamper-proof construction, and may be printed with any number of visual or tactile designs.

The sealing strip 169 is sealed on to the blister strip 165 to produce a plurality of encapsulated single units which are then separated into individual units in the second work station 26 and passed on to a final delivery station 81. In this embodiment the strip is separated into units using a cutting tool, however, equivalent methods could be used such as pre-formed perforations or deformations.

When the desired number of blister-packed smokeless tobacco pouches have been produced, a second set of assembly instructions is provided to the machine 10, which allow the machine to produce blister-type packages each containing a lozenge.

For this purpose, the second product supply system 22 (FIG. 1) comprises a container with a plurality of lozenges. At the packer 60, the first work station 25 is configured to place a single lozenge in each recess 167 in the blister strip and the second work station 26 is configured to position the sealing strip 169 over the blister strip, and to separate them into units as described above. Each unit may contain a single blister. Alternatively blister strips may be cut into units containing two or more blisters.

When it is desired to change over the machine from the packaging of snus to the packaging of lozenges, the second product supply system 22 can be loaded with lozenges whilst the machine is running, thus facilitating changeover, and reducing downtime. Similarly, where the transfer equipment 24 is pre-programmed with instructions to receive products from one or other of the supply systems 21, 22, its mode of operation can be changed with a minimum of delay.

If desired, an additional product supply system (not shown) may be provided for the manufacture on the same machine a third product in a blister pack on the same machine, for example a nicotine patch, i.e. an adhesive patch which, when applied to a user, will release nicotine. In this case a third product supply system comprising a hopper containing individual nicotine patches is provided. With the first and second product supply stations de-activated, a third set of assembly instructions may be provided to the machine 10, which allow the machine to produce blister-type packages each containing a nicotine patch using a similar assembly process to that described above. At the packer 60, the first work station 25 is configured to place a single patch in each recess of the blister strip 165, and the second work station is configured to seal the sealing strip 169 to the blister strip, and to separate the blisters into units. Each unit may contain a single or multiple blisters, for example five blisters.

Alternatively the additional product supply system may be constructed so as to be interchangeable with either or both the product supply systems for transporting the other products (cigarette bundles 110 or sealed pouches 163) to the machine, so that the machine can be prepared for the production of the third product, e.g. nicotine patches, whilst for example the first product is being manufactured using the first product supply system. In this case the second product supply system can be removed, and replaced by the third product supply system.

The machine of FIG. 1 may be further modified to enable any of the packaged products described above to be re-packed into larger containers. For this purpose a third product supply system 23 is provided, indicated in broken lines in FIG. 1. The third product supply system 23 is adapted to transport into the machine 10 the blister packs previously produced on the machine by the process described above. A third packaging material supply system 43, also indicated in broken lines in FIG. 1, is provided which transports into the machine 10 blanks for the larger containers. A third work station 27 is provided for assembling the blanks for the larger containers, and filling them with the previously packaged products from the third product supply system 23. The larger containers may for example be rectangular and correspond to the outer measurements of the individual blisters such that ten sealed blisters may be placed in a stacked arrangement in one box. Other sizes, shapes, and configurations for the larger containers could be provided. The packed containers may be further coded, printed, labeled, and wrapped in a final assembly process (not illustrated).

In use, the products in the sealed blister packs would be taken from the delivery point 81 and passed a second time through the machine 10 on a third transport route during which the sealed blister packs are packaged into the larger containers. The third packaging material supply system 43 and the third work station 27 can be prepared for use whilst the blister packed products themselves are still being produced. When the production run of the product comes to an end, the re-packaging operation can be initiated quickly with a minimum of downtime of the machine.

As some products described in these Examples may be sensitive to certain environmental factors, a machine according to this embodiment preferably comprises appropriate means such as insulating material and/or temperature control means such that the products handled by the machine are maintained under desired ambient conditions. For example, some smokeless tobacco products are preferably maintained refrigerated, for example at or around 4° C. Furthermore, cigarettes are preferably packaged under conditions of standard relative humidity. To effect any necessary or desired product handling conditions, the entire machine 10 may for example be placed in a temperature-controlled environment, or temperature controlling means may be provided in and along the transport routes through the machine. The person skilled in the art will appreciate that machines built to process products of the kind described herein may preferably be built at least to the appropriate food-grade standards, be provided with materials, lubricants and the like which are approved for equipment involved in food handling and be maintained at a high level of cleanliness.

FIGS. 3 and 4 are schematic diagrams of a more complex machine 10 according to the present invention. The operation of the machine 10 is illustrated schematically as a flow chart in FIG. 3. FIG. 4 illustrates one possible factory layout for the machine 10.

The machine 10 is configured to pack up to five or more different types of tobacco industry product in three or more different pack types. Means 20 (indicated by the box 20 in FIG. 3) for transporting the tobacco products into the machine comprises five separate product supply systems, 22*a*-22*e* for transporting four different types of product into the machine. The construction of the supply systems will depend on the type of product being supplied, and any of the conventional systems used in the packaging of tobacco industry products may be used. For example the products may be supplied as a stream of individual cigarettes, or as bundles of cigarettes, with or without wrapping, or as pre-packed groups of cigarettes in open containers such as blisters, books, racks, or trays.

In this example, the first and second product supply systems 22*a* and 22*b* are configured to supply cigarettes of different types into the machine in continuous streams. As illustrated in FIG. 4, these product supply systems may for example comprise conventional cigarette hoppers or feed trays coupled to conveyor systems which, when activated, feed cigarettes at a controlled rate into the machine. The third product supply system 22*c* is configured to transport cigarettes in pre-made foil-wrapped bundles into the machine. The fourth product supply system 22*d* is configured to transport pre-made packs of cigarettes into the machine for further packaging operations. The fifth product supply system 22*e* is configured to transport pre-packed groups of cigarettes in open blister packs or open drums into the machine. Additional product supply systems may be added to the machine from time to time, or installed in place of the then current supply systems 22 in order to permit still further types of product to be transported into the machine for packaging, according to varying manufacturing requirements.

The products selected for packaging may be transported into the machine 10 along any one of the different transport routes from the product supply systems 22*a*-*e*, and are conducted through the machine by transport equipment appropriate for the products, for example conveyor belts, conveyor chains, gravity feed systems, pick- and place devices or any of the feed systems conventionally used in the packaging industry. The transport equipment is arranged in such a way that, by selectively activating the different components of the transport equipment, different transport paths may be established for the products through the workstations.

As illustrated in FIG. 4, conveyors are used to transfer product from the supply systems 22*a*-*e*, from which products are picked either individually or in groups by a pick-and-place system illustrated as a robot arm 25. The arm has a base that is rotatable about a vertical axis, a lower arm section articulated to the base for movement about a horizontal axis, and an upper arm section articulated to the lower arm section for independent movement about a horizontal axis, permitting the end of the upper arm to be positioned in space relative to three orthogonal axes. The end of the upper arm section of the robot arm 25 carries a replaceable pick-up tool, or end effectuator, that is adapted to select and manipulate the products concerned. The end effectuator is articulated to upper arm section by a joint permitting movement in about three orthogonal axes relative to the end of the arm. The robot arm 25 is therefore capable of manipulating and positioning products with 6 degrees of freedom of movement.

The end effectuator itself is selected from a range of interchangeable tools each adapted to pick up specific products in units that may consist of individual products or bundles of product. Any suitable commercially available type of robot arms and end effectors may be used, for example tools incorporating moveable blades operable by pneumatic cylinders could select and guide certain numbers of products, and vacuum cups selectively communicable with a vacuum source could retrieve, hold, move and release packages.

The robot arm 25 picks up product units conveyed from the product supply systems 22*a*-22*e*, as required, in accordance with operating instructions programmed to control the robot arm, and transfers them on to either of two conveyors that transport the product to either of two further workstations 61, 68, the function of which will be described below. In one mode of operation, the robot arm 25 may pickup products from only one of the product supply systems. In another mode of operation, it may be programmed to pick up products from two or more of the product supply systems in a desired sequence and to combine the products into a larger groups for onward transport to the next workstation 61 or 68. This is particularly useful where mixed packs of products are to be manufactured, Thus, for example, if four of the supply systems 22*a*-22*d* are loaded with cigarettes of different strengths of flavours, the robot arm 25 may be programmed to pick op cigarettes in groups of 5 from each of the four work stations in turn and to assemble them into bundles of 20 for delivery to the next workstation 61, or 68.

Means 40 for transporting packaging material into the machine 10, indicate 25 pick up 5 cigarettes from each of the supply systems 22*a*-22*d* in turned in FIG. 3 by the two boxes 40, comprises seven separate packaging material supply systems 42*a*-*g*. The construction of the individual supply systems will depend upon the type of packaging required, and any of the conventional packaging supply systems used for tobacco industry products may be used. In this example, first and second packaging materials supply systems, 42*a* and 42*b*, are configured to hold stacks of blanks 102, 106 for the two-part pack described with reference to FIGS. 1 and 2, and to transport them into the machine 10, the first system, 42*a* supplying blanks for the inner frames 101, the second, 42*b*, supplying blanks for the outer frames 105. A third packaging material supply system 42*c* transports foil 111 into the machine for wrapping bundles of cigarettes. A fourth packaging material supply system 42*d* transports empty pre-formed packs, (such as blister strips 165 as described with reference to FIG. 6), drums or other rigid containers, into the machine, which are closed using sealing foil or caps. The last-mentioned packaging materials are transported into the machine by the fifth and sixth packaging material transport systems 42*e*, 42*f*, the fifth system 42*e* transporting sealing material for blister packs (for example the sealing strip 169 illustrated in FIG. 6) the sixth system, 42*f*, transporting caps. A seventh material supply system 42*g* transports packaging material into the system for repackaging pre-made packs of cigarettes into multiple packs.

The packaging material supply systems described above may be modified to provide any other desired packaging materials for the machine. For example the sixth system 42*f* may be configured to supply add-on items, such as promotional items, product information material or other rigid items to the packer 60 to be combined into the final the packs. Additional packaging material supply systems may be added to the machine from time to time, or installed in place of any of the then current material supply systems 42*a*-*g* in order to permit still further types of packaging materials to be transported into the machine, according to varying manufacturing requirements.

A packer, indicated generally at 60 in FIG. 3 receives packaging materials from the packaging material supply systems and the product supply systems. The packer 60 comprises a number of different work stations 61-70 interconnected by the transport equipment for performing assembly operations on the packaging materials and products in selected sequences to incorporate particular products in particular packaging, as desired.

A wrapping work station 61 receives foil or other wrapping material 111 from the third packaging material supply system 42*c* and is capable of wrapping bundles of cigarettes 110 received from either the first or second product supply system 22*a* or 22*b*, according to which transport route is selected for the products.

An inner blank forming workstation 62 receives inner frame blanks 102 from the first packaging material supply system 42*a*, performs the assembly operations on the inner blanks described with reference to FIG. 2 and transports them to an inner frame filling workstation 63. This workstation 63 also receives foil-wrapped bundles of cigarettes 110 from the wrapping work station 61 and is capable of inserting each wrapped bundle 110 into an erected inner frame 101, as shown in FIG. 2.

An outer frame forming work station 64 receives blanks 106 for outer frames 105 from the second material supply system 42*b* and performs the assembly operations thereon described with reference to FIG. 2.

A pack assembly work station 65 receives filled inner frames 101 from the inner frame filling station 63 and erected outer frames 109 from the outer frame forming work station 64. The pack assembly work station 65 is capable of inserting the filled inner frames 101 into outer frames 105, and performing other operations to complete the assembly of the pack as shown in FIG. 2.

Alternatively, pre-made foil-wrapped bundles 110 may be transported from the third product supply system 22*c* directly to the inner frame filling workstation 63 along a transport route that either bypasses the wrapping workstation 61, or, as illustrated in FIG. 4 and by the broken lines in FIG. 3, passes though it whilst the wrapping system is inoperative. In this mode of operation the end of the robot arm 25 illustrated in FIG. 4 will be provided with a tool adapted to pick up and place individual foil-wrapped bundles of cigarettes from the conveyor leading from the third product supply system 22*c*, rather than groups of cigarettes for foil-wrapping.

The packer 60 further includes a pack combining work station 66 that is capable of applying further packaging to pre-made packs of products, for example to combine two or more standard packs of cigarettes into a single pack, known as a multi-pack. The further packaging materials for this operation are transported into the machine from the seventh packaging materials supply system 42*g*, through a further packaging material assembly work station 67, which glues and folds the further packaging as required, and thence to the pack combining work station 66. Pre-made packs of cigarettes, formed for example on a conventional cigarette packing machine (not shown) and stored in a hopper in the fourth product supply system 22*d* are transported from the fourth product supply system 22*d* to the pack combining workstation 66 along a transport route that bypasses (or passes through whilst inoperative) the wrapping work station 61, the inner frame filling station 63 and the pack assembly workstation 65, as indicated in broken lines in FIG. 3. In this mode of operation, the robot arm 25 will be provided with a tool that picks up pre-filled packs from the fourth product supply station individually or in groups, depending up on how many are to be combined into a multi-pack, and the specific packaging operation to be used. At the pack combining work station 66, the pre-filled packs are packed in the further packaging material to form the multi-pack.

In a modification, the machine of FIGS. 3 and 4 is configured to package cigarettes in an alternative known flip-top pack in which an outer frame with a flip-top contains a cavity, optionally formed of plastics material, that defines two separate wells for holding ten cigarettes each. Such packs are especially suitable for menthol cigarettes. In this modification, the seventh packaging materials supply system 42*g* is arranged to supply blanks for the outer frame of the pack, and the fourth product supply system 22*d* is provided with pre-formed bundles comprising a formed plastic cavity each containing ten cigarettes. The robot arm 25 is provided with a tool that picks up pre-filled packs in pairs from the fourth product supply system 22*d* and places them on to the conveyor system that transports them to the pack combining work station 66 via the foil-wrapping workstation 66, the inner frame filing station 63 and the pack assembly workstation 65, which are deactivated in this mode of operation of the machine. In pack-combining workstation 66, the pairs of bundles are assembled with the blank for the flip-top pack that is transported into the workstation 66 from the seventh material supply system 42*g*.

If desired, the machine can be re-configured to pack two different cigarettes in a single pack. In this arrangement, pre-formed bundles comprising a formed plastic cavity each containing ten 3 mg menthol cigarettes are provided in the fourth product supply system 22*d*, and similar bundles containing ten 10 mg menthol cigarettes are provided in the fifth product supply system 22*e*. The robot arm 25 is programmed to pick pre-formed bundles alternately from the fourth and fifth product supply systems 22*d* and 22*e* and to place them in pairs on the conveyor that transports them to the pack combining work station 66. The pairs of bundles containing different products are then assembled with the blank for the flip-top pack that is transported into the workstation 66 from the seventh material supply system 42*g*.

It will be appreciated that the pack combining work station 66 is actuated selectively so that in either of the foregoing modes of operation of the machine, it operates only in combination with the fourth product supply system 22*d*, the seventh material supply system 42*g* and the further packaging assembly station 67. Similarly, the pack combining work station 66 will be inoperative when the machine 10 is being operated in other modes, for example, when the machine is being used to pack products in accordance with the process illustrated in FIG. 2. In this mode of operation, the pack combining workstation 66 allows the products to pass through without performing any further operations thereon.

The person skilled in the art will appreciate that when changing over the mode of operation of the machine, the conveyor systems or other transport systems within the machine may require re-configuration to provide it with pockets or other retainers for conveying the different products or combinations of products to the selected workstations in the desired orientations for processing.

Work stations that are deactivated during production of a certain type of packaged product may alternatively be removed. This may allow for more expedient movement of product and packages along the transport route and may offer an opportunity for maintenance, repairs, alteration, or replacement of the work station. In some embodiments, however the work stations are not easily moved and are merely activated and deactivated as necessary.

The packer 60 includes a further filling work station 68 which is capable of packaging products such as cigars, cigarillos or cigarettes in pre-formed rigid or semi-rigid packs that are closed with a seal and/or cap, for example tubes, drums, or blister packs. The assembly process for blister packs is similar to that described above with reference to FIG. 6.

In this example, blister packs capable of holding, for example, 10 cigars or 50 cigarettes are transported into the machine from the fourth packaging material supply system 42*d* to the filling workstation 68. The filling workstation 68 also receives cigars or cigarettes from the first or second product supply systems 22*a* or 22*b*. The filled blister packs are then transported into a sealing work station 69, which seals the blister pack with sealing strip supplied from the fifth packaging materials supply system 42*e*. The sealed blister packs may then be transported out of the system via a capping work station 70 (described below) which is deactivated when the machine 10 is configured to produce blister packs.

The fourth material supply system 42*d* may be modified to supply, or interchanged with equipment that supplies other forms of container, for example tubes or drums. An assembly process for packs in this form is illustrated by way of example in FIG. 5. Cigarettes from the first or second supply systems 22*a* or 22*b* are transported into the machine and are grouped into bundles of 50 by the robot arm 25, which carries an appropriately adapted pick-up tool for transferring bundles of cigarettes 151 on to the conveyor that transports the bundles 151 into the filling workstation 68. This may for example be achieved by providing conveyors with recessed wells sized and configured to hold cigarettes in cylindrical bundles of 50.

The filling workstation 68 also receives empty drums 153 transported into the machine from the fourth material supply system 42*d*. The drums 153 are open at one end and closed at the other. The drums are filled with the bundles of 50 cigarettes in the desired orientation. The filled drum is then transported through the sealing work station 69, which at which a sealing foil 155 from the fourth material supply station 42*d* is applied and sealed to the open end of the drum, enclosing the bundle of cigarettes. The edges of the sealing foil 155 extending beyond the sealed drum may be cut, such as with a laser or otherwise removed to provide a smooth finished appearance. Alternatively pre-cut seals may be applied directly to the open end of the drum and sealed thereto, avoiding the need for cutting. The sealed drums are then transported into the capping workstation 70, which is constructed to apply caps 157 to the drums. The capped and sealed drum are then transported to a final assembly area 71.

Since the final assembly area can receive product either from the conveyor system leading from the pack combining workstation 66 or the conveyor system from the capping workstation 70, a further pick- and place device 80 is constructed to transfer packs of product selectively from either of these conveyor systems, according to the mode of operation of the machine 10, and to place them on to a further conveyor system that transports the packs into the final assembly area 71.

In final assembly area 71 the packs emerging from the packer 60 are subjected to a further sequence of packaging operations conventionally used in the packaging of tobacco industry products. Since these operations are conventional, and will be familiar to a person skilled in the art, they will be described in outline only in this specification. In the case of cigarettes, as indicated schematically in FIG. 3, these operations typically include the application of a code, for example by laser or ink jet printing, to each pack in a coding station 71*a*, applying labels to the packs in a labelling station 71*b*, inserting coupons in the packs in a coupon placement stations 71*c*, performing a visual inspection of the packs in an inspection station 71*d*, applying a tax stamp in a stamping station 71*e*, wrapping the packs in film in a pack wrapping station 71*f*, loading packs in groups into cartons in a carton forming station 71*g*, applying product codes to the cartons in a coding station 71*h*, wrapping the cartons in a wrapping station 71*i*, loading cartons into cases in a case forming station 71*j*, closing the cases in a closing station 71*k* and sealing the cases in a sealing station 71*l*. Cases of packed products are then delivered to a delivery point 81 and removed for transportation.

The person skilled in the art will appreciate that the above operations are indicated by way of example only, and some of the operations may omitted or varied according to the particular product being packed. For example, depending on the particular sequence of assembly operations required, one or more of the operations performed in the final assembly area may be performed at a workstation in the packer 60.

The product supply systems 22*a*, the robot arm 25, the pick and place device 80, the packaging materials supply systems 42*a*-42*g*, the workstations 61-70 and the transport means, are all operated by conventional electrical drives having digital electronic control systems that are operated in coordination with each other from a central programmable computer control device (not illustrated). The control device itself has a program code means installed therein, whereby the computer may instruct a machine to carry out any of the sequences of operation of the machine described herein. The construction of the control device and the program code will vary according to the equipment used in each embodiment, but the design thereof will be within the capability of any person skilled in the art.

Where the machine of the invention is constructed for packing cigarettes in alternative packs, consideration should be given to the interaction between the different types of cigarettes and packages. For example, flavoured cigarettes, particularly with volatile flavourants such as menthol, may tend to leach flavour or scent onto to nearby products such that it may be preferred to only run products having a particular flavour all at once, and not with dissimilarly flavoured products As machines of the invention are intended for use with novel packaging types as well, then, it is foreseeable that there may be flavourants or other volatile materials incorporated in or applied to certain of the packaging which might similarly leach or affect nearby packaging or smoking products such that their supply to the machine might be limited to certain times when other dissimilarly treated products are not being processed.

Similarly, when a machine of the invention is used to package smoking products which are governed by strict hygiene rules, such as chewing tobacco or snuff which can be deemed a food stuff, or lozenges which can be regulated as a pharmaceutical, standards applying to these class of goods would be required. A machine packaging any such product can easily be configured, cleaned, and maintained by a skilled person to comply with the necessary limitations while still taking full advantage of the benefits of the novel configuration of the invention.

Similar modifications or adjustments can be made between batch runs if a machine is packaging smoking products for different markets, to ensure compliance with the rules from each relevant market.

The machine described with reference to FIGS. 3 and 4 can be configured with a plurality of supplies, transporting routes and work stations so as to package a variety of tobacco industry products into various different packaging types. The following Example describes one of the many combinations available.

EXAMPLE 3

In this example, similar tobacco industry products, in this case cigarettes are packaged in a plurality of different packaging types, namely in standard packs holding twenty cigarettes per package and in lidded drums holding fifty cigarettes per package. Whereas conventionally one would need to set up two separate packaging lines, according to the invention a single machine can carry out both procedures, and can be changed between the two procedures more quickly and with a reduced downtime for the machine compared with conventional high-speed cigarette packing machines.

The central control system of the machine 10 is first programmed to produce cigarettes in flip-top packs of 20 using the assembly process of FIG. 2. In this configuration, cigarettes are provided to the machine on conveyors from the first or second product supply systems 22*a* or 22*b*, inner frame and outer frame packaging is provided to the machine from the first and second packaging material supply systems 42*a* and 42*b* and foil is provided to the machine from the third material supply system 42*c*.

The robot arm 25 is fitted with a pickup tool that select groups of twenty cigarettes from the conveyors and configure them in three parallel adjacent rows, the outer rows containing seven cigarettes each and the inner row containing six cigarettes, and delivers the bundles to the wrapping work station 61 where they are wrapped in foil. The foil wrapped bundles are transported to the inner frame filling station 63, where they are inserted into inner frames that have been transported to the same station 63 from the first packaging material supply system 42*a*.

The filled inner frames are transported to the pack combining work station 65 where each inner frame is inserted into an outer frame received from the second packaging material supply system 42*b*. The outer frame is closed around the inner frame as indicated in FIG. 2, and the assembled pack is transferred by the pick-and-place device 80 on to a conveyor that transports the packs into the final assembly area 71 to be further processed according to the selected final assembly steps.

After producing the desired number of standard packs of 20 cigarettes, the central control system of the machine 10 is re-programmed to produce cigarettes in drums containing 50 cigarettes, using the assembly process described above with reference to FIG. 5. In this configuration, cigarettes are provided to the machine from the first or second product supply systems 22*a* or 22*b*, drums are provided to the machine from the fourth material supply system 42*d*, sealing material and lids for the drums are supplied to the machine from the fifth and sixth material supply systems 42*e* and 42*f*. The robot arm 25 is fitted with a pick-up tool that transfers cigarettes in groups of 50 to the conveyor that feeds the drum filling workstation 68. The machine is then operated as described above to effect filling, sealing and capping of the drums at the filling, sealing and capping workstation 68, 69 and 70, as described above.

The filled, sealed and capped drums are then are transferred by the pick-and-place device 80 on to the conveyor that transports the drums to the final assembly system 71. It will be evident that the mode of operation of the pick-and-place device 80 differs in this mode of operation of the machine 10 in that the workstation 70 provides the input to the device 80 rather than workstation 66. In the final assembly station 71, the drums are labeled, coded, and over-wrapped as necessary, packed into suitable bulk containers and transported to the delivery point 81 for transport.

As will be evident to skilled persons, the work stations of the packer may require modification when the operation of the machine 10 is switched between the two packaging production modes. However, many of the modifications required for one mode of operation can be performed whilst the machine is operating in the other mode, in particular the loading of the packaging materials supply systems. Furthermore, the robot arm 25 and the pick-and-place device 80 can be pre-programmed to operate selectively in either of the above modes and changed from one mode of operation to the other by selecting the appropriate control programmes. Downtime of the machine when changing the mode of operation can therefore be reduced between production runs.

The machine of FIGS. 3 and 4 may be provided with one or more additional workstations for selectively performing packaging operations on the product.

For example cigarettes with filter tips are usually assembled into a pack so that the filter tip is displayed to the consumer when the pack is opened. However, some cigarettes have closed ends, that is, they have wrapping paper across the end opposite the filter, obscuring the view of the tobacco. With closed end cigarettes, it may be desired to provide some packs with the filter end facing downward so as to display the closed end to the consumer when the pack is opened.

To produce packs having cigarettes oriented in either direction on conventional cigarette manufacturing equipment is problematic because conventional machines are configured to hold cigarettes in one orientation only with respect to the pack. Small differences in the diameter of cigarettes at the filter end versus the tobacco end are at times exploited in the mechanism of high-speed packing machinery, which excludes the possibility of simply feeding cigarettes into the machine in the opposite orientation.

In a modification of the machine of FIGS. 3 and 4, the inner frame filling station 63 includes a mechanism, for example a numerically-controlled robotized system, which, when activated, rotates the foil wrapped bundles 110 (see FIG. 2) through 180°. By selectively activating this mechanism, the products can be packed in either of two orientations. The machine may be provided with a workstation that includes a similar selectively-activated robotized system may be used to orient individual cigarettes or groups of cigarettes within a larger group before packaging.

A further modification of the machine of FIGS. 3 and 4 is illustrated in FIG. 4*a*. In this modification, a further robot arm 25*a* is positioned to transfer products selectively in three different modes. In the first mode, the robot arm transfers product from the frame filling workstation 63 to the pack assembly workstation 65, so that the machine performs the same sequence of operations as previously described. In the second mode of operation, the robot arm 25*a* transfers product from the sealing workstation 69 to the capping workstation 70, again to enable the performance of same sequence of assembly operations as described previously. In the third mode of operations, the robot arm 25*a* transfers blister packs from the sealing workstation to the pack assembly workstation 65. In this third mode of operation, the pack assembly workstation 65 is configured to package blister packs into larger packs.

The machine can quickly and easily be switched between the production of the flip-top packs as illustrated in FIG. 2, blister strips as illustrated in FIG. 6, and packs of blister strips with a minimum of downtime.

Modules and means not specifically described herein can be standard equipment known in the industry, however, as new and improved means and methods become available they may be incorporated into a machine of the present invention. For example, film wrap equipment and the film used therein are well-known and provided in a plurality of different sizes, speeds and configurations. Existing or modified over-wrapping machines may be used as work stations. Because the machine is specifically intended for use with a multitude of different packaging types, though, film wrap may preferably be provided in novel ways or may not be required at all.

For example, the invention is applicable for packing cigarette cases, which could be provided in a shape such as rectangular. A rectangular case could be film wrapped in generally the same manner as a rectangular pack of cigarettes. However, the case could be spherical, which could necessitate some adjustments to the film wrap and the manner of applying it to the packages. Alternatively, where the case is formed to seal shut so as to isolate the inner environment, and/or where the smoking products therein are already wrapped so as to protect them from the elements, no film wrap may be needed.

Other process choices to be elected by the skilled worker include determining whether the machine is configured along a single axis with different elements feeding into a central transport route, or whether it is configured in a series of interconnected parallel routes, or in some other configuration. At the described configuration, when handling cigarettes the machine may process about 1,500-4,000, preferably about 2,000 cigarettes per minute. Given that many units preferably comprise 20 cigarettes, the machine could therefore pack approximately 50-200 packs per minute, more specifically 75-150 packs per minute, more specifically about 100 packs per minute. Thus, traditional straight line, non-flexible manufacturing might remain the preferred solution for large volumes of standard materials which rarely change, whereas a machine according to the invention might better be utilized to fulfil unmet needs in the art, and used where there are limited use packages, possibly in the form of limited duration printed material on a standard package, limited amounts of unconventional articles in conventional packaging, or the like.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A method of packaging tobacco industry products in which the products and packaging materials are subjected to successive assembly operations that incorporate products in packs formed from the packaging material, the method comprising:

transporting a first batch of products, from a first supply system, through a set of workstations, the set of workstations being positioned serially along at least one of a plurality of non-overlapping parallel transport routes, each workstation of the set of workstations having a dedicated packaging material supply system, the dedicated packaging material supply systems collectively forming a second supply system;

the method further comprising the following steps:

supplying a first type of packaging material to a first workstation of the set of workstations from the corresponding dedicated packaging material supply system, the first type of packaging material forming part of a first finished product;

supplying a second type of packaging material to at least one other workstation of the set of workstations from the corresponding dedicated packaging supply system, the second type of packaging material forming part of a second finished product;

incorporating products of the first batch in the first type of packaging material at the first workstation by performing successive assembly operations at the first workstation to form the first finished product;

incorporating products of the first batch in the second type of packaging material at the at least one other workstation by performing successive assembly operations at the at least one other workstation to form the second finished product; and transporting a second batch of products through a set of workstations along one of the plurality of transport routes and performing thereon successive assembly operations that incorporate the products in the packaging materials to form finished products, one of the products and the packaging materials of the second batch being transported or supplied from at least one further supply system and the other of the products and packaging materials of the second batch being transported or supplied from one of the first supply system and the second supply system, wherein said successive assembly operations comprises selectively operating workstations positioned serially along a single transport route according to the particular pack being assembled; and wherein the transporting and performing steps are carried out such that the first and second batches incorporate one of:

said product in packs of different types, and different products in packs of the first type.

2. The method according to claim 1, further comprising utilizing a controller to cause products to be transported along a selected one of a plurality of sequences of assembly operations.

* * * * *